US008272633B2

(12) United States Patent
Yoshida et al.

(10) Patent No.: US 8,272,633 B2
(45) Date of Patent: Sep. 25, 2012

(54) IMAGE FORMING APPARATUS

(75) Inventors: Takeshi Yoshida, Osaka (JP); Yoshiyuki Asakawa, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 370 days.

(21) Appl. No.: 12/731,293

(22) Filed: Mar. 25, 2010

(65) Prior Publication Data

US 2010/0244355 A1 Sep. 30, 2010

(30) Foreign Application Priority Data

Mar. 26, 2009 (JP) ..... 2009-075964
Mar. 11, 2010 (JP) ..... 2010-054814

(51) Int. Cl.
*B65H 39/00* (2006.01)

(52) U.S. Cl. ..... 270/58.13; 270/58.28; 271/207; 271/279; 271/292

(58) Field of Classification Search ..... 271/207, 271/220, 279, 178, 292; 270/58.13, 58.07, 270/58.08, 58.28
See application file for complete search history.

(56) References Cited

U.S. PATENT DOCUMENTS 6,353,727 B1 3/2002 Muraoka et al.
6,942,206 B2 * 9/2005 Kuwata et al. ..... 270/58.08
7,226,050 B2 * 6/2007 Sekiyama et al. ..... 271/213
7,483,669 B2 * 1/2009 Satozaki ..... 399/405
2005/0051941 A1 * 3/2005 Nagata et al. ..... 270/58.08
2006/0237900 A1 * 10/2006 Sekiyama et al. ..... 271/220
2008/0044214 A1 2/2008 Nakajima

FOREIGN PATENT DOCUMENTS

JP 2001-48403 A 2/2001
JP 2001-270642 A 10/2001
JP 2008-44771 A 2/2008

* cited by examiner

*Primary Examiner* — Kaitlin Joerger
*Assistant Examiner* — Ernesto Suarez
(74) *Attorney, Agent, or Firm* — Hoffmann & Baron, LLP

(57) ABSTRACT

An image forming apparatus includes a main housing, a post-processing unit including a pivotable processing tray, and a recording medium discharging outlet. The processing tray includes a lock member, urging member and lock releasing member. The lock member is supported movably between first and second positions. The lock member engages with an engaging hole at the first position and disengages from the engaging hole at the second position. The urging member urges the lock member towards the first position. The lock releasing member resists a force applied by the urging member so as to allow the lock member to travel to the second position. A recording medium depressing member is disposed within a pivotal range of the lock member. A first slope is provided on at least one of a contact portion of the lock member and a contact portion of the recording medium depressing member.

8 Claims, 17 Drawing Sheets

IMAGE FORMING APPARATUS

This application is based on and claims the benefit of priority from Japanese Patent Application No. 2009-075964, filed on 26 Mar. 2009 and Japanese Patent Application No. 2010-054814, filed on 11 Mar. 2010, the contents of which are incorporated herein by reference.

BACKGROUND OF THE INVENTION

1. Field of the Invention

The present invention relates to an image forming apparatus such as a digital copier, and in particular relates to an image forming apparatus that is provided with a post-processing unit installed in an internal space for discharging sheets of paper.

2. Related Art

With a conventional image forming apparatus utilizing electrophotography, heat and pressure are applied to a sheet of paper so as to fix toner transferred on it during a fixing process, so that the temperature of the sheet of paper tends to go beyond 100 degrees Celsius. It is normal that a sheet of paper always contains the moisture of a few percent and the moisture tends to gradually increase during storage subsequent to its production. In particular, after a wrapping paper covering a stack of paper is removed, the moisture percentage of the sheet of paper will increase remarkably.

The moisture contained in the sheet of paper rapidly evaporates when the heat and pressure are applied to the sheet of paper during the fixing process. In this process, the local difference in the moisture percentage occurs between the front surface and the back surface of the sheet of paper, and so on. In addition, there are a spot filled with and the other spot not filled with the moisture evaporated from the sheet of paper in the vicinity of a fixing unit, in particular, an area in the vicinity of the front surface and the back surface through which the sheet of paper travels. The sheet of paper with a high temperature, which has just been discharged from the fixing unit, travels through this area having the nonuniformity of moisture distribution and is carried to an outlet.

In this manner, it may be that the sheet of paper having received heat and pressure during the fixing process suffers from curls (curl habit). FIG. 17(*a*) is a perspective view illustrating sheets of paper 101 being stacked on a discharging tray, and FIG. 17(*b*) is a view on arrow illustrating one of the sheets of paper 101 shown in FIG. 17 (*a*), as seen in a direction of arrow Y. As shown in FIGS. 17(*a*) and 17(*b*), the sheets of paper 101, which have been discharged along a discharging direction of paper (a direction of arrow X in FIG. 17(*a*)), have remarkable curls at left and right end portions 101*a* of the sheets of paper 101. As an amount of curling varies according to the pressure applied to the sheets of paper 101 by a pressure roller of the fixing unit, the height "h" of a curl at the left and right end portions 101*a* possibly reaches as much as 30 mm. In addition, the cause contributing to the nonuniformity of moisture brings about complex curls on the sheet of paper. Furthermore, the height of curl tends to depend significantly on the characteristics of the sheet of paper such as the direction of fibers in addition to the amount of moisture contained in the sheet of paper.

It has been likely that local curling of the sheet of paper not only shuts the paper outlet, remarkably damaging the performance in terms of arrangement and stacking of paper discharged onto the discharging tray, but also pushes in the discharging direction of paper out to drop sheets of paper previously stacked off the discharging tray. In this manner, curling of the sheet of paper has more than a few unfavorable effects on the stacking of discharged paper. On the other hand, there is a fact that the occurrence of curling of paper having undergone fixation is unavoidable for an image forming apparatus utilizing electrophotography, which requires a fixing process in which heat and pressure are applied to a sheet of paper during an image forming process. In addition, another image forming apparatus utilizing another type of image forming processes differing from electrophotography possesses a common problem associated with the deterioration in stacking of discharged paper on the discharging tray due to curling of the sheet of paper having traveled through the image forming apparatus, although the amount of curling and the cause for it differ from those of sheets of paper having undergone electrophotography processes.

Various approaches for correcting curling of discharged paper have been proposed. For example, an image forming apparatus employing a sheet member is known, having the following features: The sheet member depresses a stack of paper previously discharged such that the top of the stack of paper is positioned below a front end of a sheet of paper subsequently discharged from a discharge roller. And the sheet member moves with aid of the front end of the sheet of paper, thereby allowing the sheet of paper to be discharged onto a discharging tray. In addition, an image forming apparatus is known, which includes a curl correction member having a shape of lever that corrects curling of a sheet of paper discharged onto a job separator tray.

On the other hand, an image forming apparatus satisfying a recent demand for saving space is known, which is provided with a post-processing unit in an internal paper discharging space that performs stapling for a stack of paper having undergone an image forming process.

In the image forming apparatus provided with the post-processing unit in the internal paper discharging space, a processing tray of the post-processing unit may be adapted to be vertically pivotable to allow recovery from jamming inside the post-processing unit and maintenance of the post-processing unit to be performed. In the above mentioned image forming apparatus, a unit main housing and the processing tray are selectably set in a fixed position or a released position, by allowing a lock member which engages with an engaging hole provided in the unit main housing to project from or retract into an end surface of the processing tray. On the other hand, for a configuration provided with the curl correction member described above, it is necessary to allow the curl correction member to project into the internal paper discharging space such that the curl correction member sufficiently depresses the top surface of sheets of paper discharged into the internal paper discharging space.

For these reasons, it is likely that the lock member projecting from the end surface of the processing tray interferes with the curl correction member while the processing tray is pivoted for recovery from jamming and the like, resulting in damaging of the curl correction member and/or the lock member. In addition, it poses a problem that if a portion of the processing tray is adapted to be pivotal such that the lock member and the curl correction member do not interfere with each other, the workability of performing recovery from jamming deteriorates due to the pivotal portion of the processing tray being apart from where a sheet of paper is introduced. Furthermore, although it may be possible to shift the position of the post-processing unit in a discharging direction of paper, this leads to an increase in the dimension of the image forming apparatus with respect to the discharging direction of paper, thereby resulting in a disadvantage if downsizing and compactness of the image forming apparatus are considered.

SUMMARY OF THE INVENTION

An object of the present invention is to provide an image forming apparatus, which can not only increase the performance in terms of maintenance provided for a post-processing unit installed in an upper portion of an internal paper discharging space, but also efficiently restrict curls occurring in sheets of paper discharged into the internal paper discharging space so as to increase the performance in terms of arrangement and stacking of the sheets of paper.

The present invention provides an image forming apparatus, comprising, a main housing, an upper housing, a connecting housing to connect the main housing and the upper housing, an inner paper discharging space provided between the upper housing and the main housing, a post-processing unit that is provided at an upper portion of the inner paper discharging space, a recording medium discharging outlet discharging recoding media from the connecting housing downward the post-processing unit, and a recording medium discharging tray that is provided at a lower portion of the inner paper discharging space and to which recording medium having image thereon which is not undergone post-processing process is discharged via the recording medium discharging outlet. The post-processing unit comprises a main unit and a processing tray that is supported pivotably in a vertical direction with respect to the main unit about an axis defined by a side of the processing tray. The processing tray comprises a lock member that is supported movably between a first position and a second position, the lock member being engagable with an engaging hole provided in the main unit at the first position while projecting from an end surface of the processing tray and disengagable from the engaging hole at the second position while being accommodated in the processing tray, an urging member urging the lock member towards the first position and a lock releasing member resisting an urging force applied by the urging member so as to allow the lock member to travel to the second position. A recording medium depressing member that depresses the recording medium having passed through the recording medium discharging outlet is disposed within a pivotal range of the lock member. A first slope is provided on at least one of a contact portion of the lock member and a contact portion of the recording medium depressing member, both of which contact each other when the processing tray pivots downward.

DETAILED DESCRIPTION OF THE INVENTION

Figure 1:
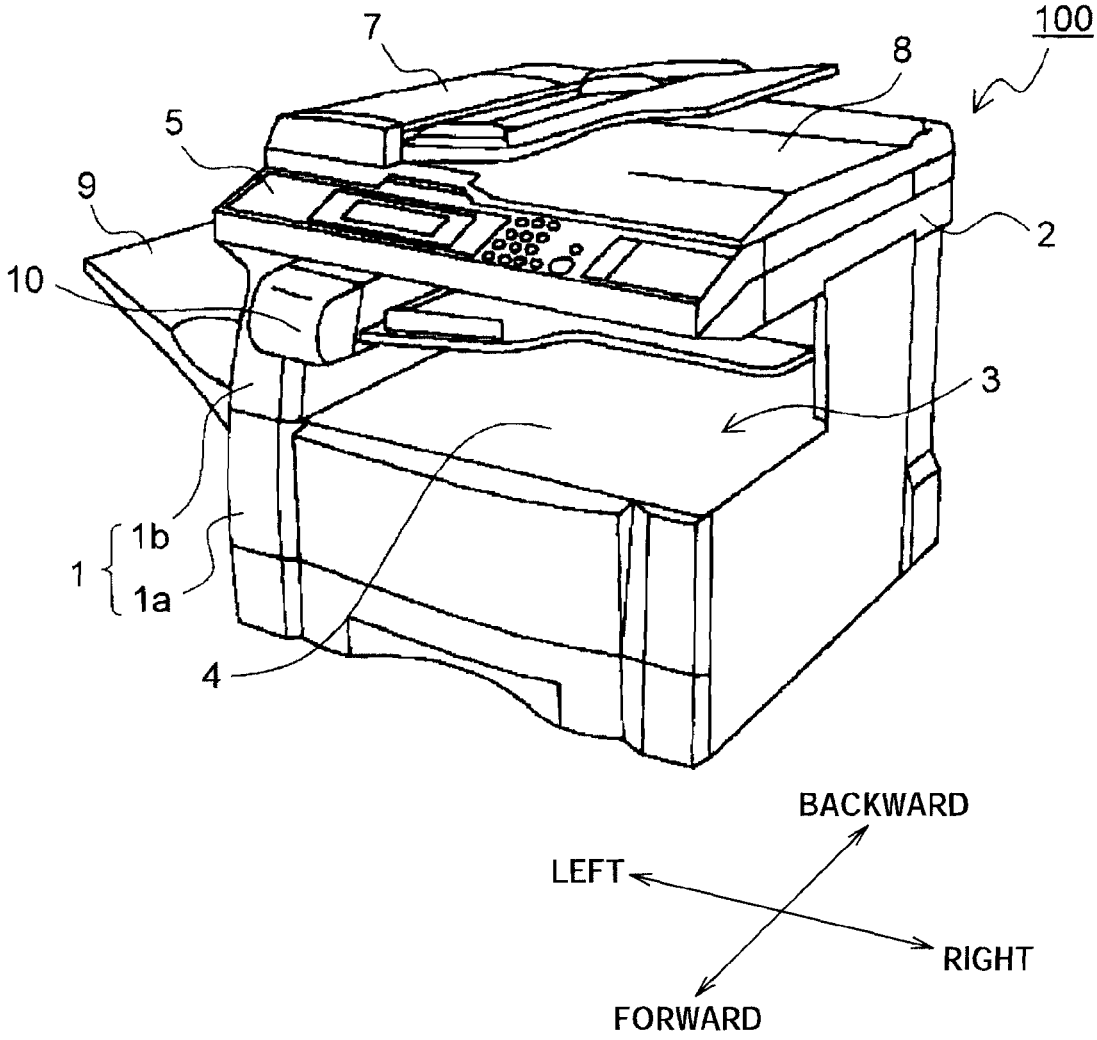
FIG. 1 is an external perspective view illustrating an image forming apparatus according to an embodiment of the present invention.

An exemplary embodiment of the present invention is described below with reference to the drawings. FIG. 1 is an external perspective view illustrating an image forming apparatus according to an embodiment of the present invention. As shown in FIG. 1, an image forming apparatus 100 is a so-called digital copier that discharges sheets of paper into its internal space, mainly including a main housing 1 and an upper housing 2 that is disposed on the main housing 1. The upper housing 2 is provided with various components that are for reading an image of a document as electric signals, which will be described later. On the other hand, the main housing 1 is provided with various components that are for forming the image onto a sheet of paper (an example of a recording medium) according to the electric signals, which will be described later.

The main housing 1 includes a lower housing 1*a* and a connecting housing 1*b*. The connecting housing 1*b* is disposed on the lower housing 1*a* at a left side of the image forming apparatus 100 and coupled with the upper housing 2. The lower housing 1*a* is provided with a paper supplier and an image forming unit for forming an image of toner on a sheet of paper, etc. On the other hand, the connecting housing 1*b* is provided with a fixing unit for fixing the image of toner on the sheet of paper and a paper discharging unit that conveys to discharge the image fixed sheet of paper. An internal paper discharging space 3, which is made open in its right and forward directions, is formed between the main housing 1 and the upper housing 2, right under the upper housing 2 and on the right side of the connecting housing 1*b*. The inner paper discharging space 3 is provided with a paper discharging tray 4 (a recording medium discharging tray) on which sheets of paper that are discharged horizontally from the right side of the connecting housing 1*b* are received to be stacked.

On an upper surface of the upper housing 2 placed are a document placing plate (not shown) including a sheet of transparent glass and an operation panel 5 extending forward. In addition, over the upper housing 2 a document holding member 8 is pivotally supported by a hinge (not shown)

provided on a backside of the upper housing 2. A document conveying unit 7 is mounted on the document holding member 8, which conveys a document to a position of the document placing plate at which reading of an image is performed. The document holding member 8 can be selectably positioned in a closed position, as shown in FIG. 1, where the document holding member 8 is closed with respect to the document placing plate such that a reading process is performed for a document and in an open position where the document holding member 8 is opened with respect to the document placing plate.

A tray 9 for receiving a discharged stack of paper on which a stack of paper having undergone a stapling process is discharged, which will be described later, projects from the left side of the main housing 1. In an upper portion of the internal paper discharging space 3 inside the main housing 1 a post-processing unit 10 is installed, which staples a predetermined number of sheets of paper on which images have been fixed. As configured like this, it is possible to allow the post-processing unit 10 not to project from the main housing 1, thereby allowing a space necessary for accommodating the image forming apparatus 100 to be compact. In addition, it is possible to allow the external contour of the image forming apparatus 100 to be simple.

Figure 2:
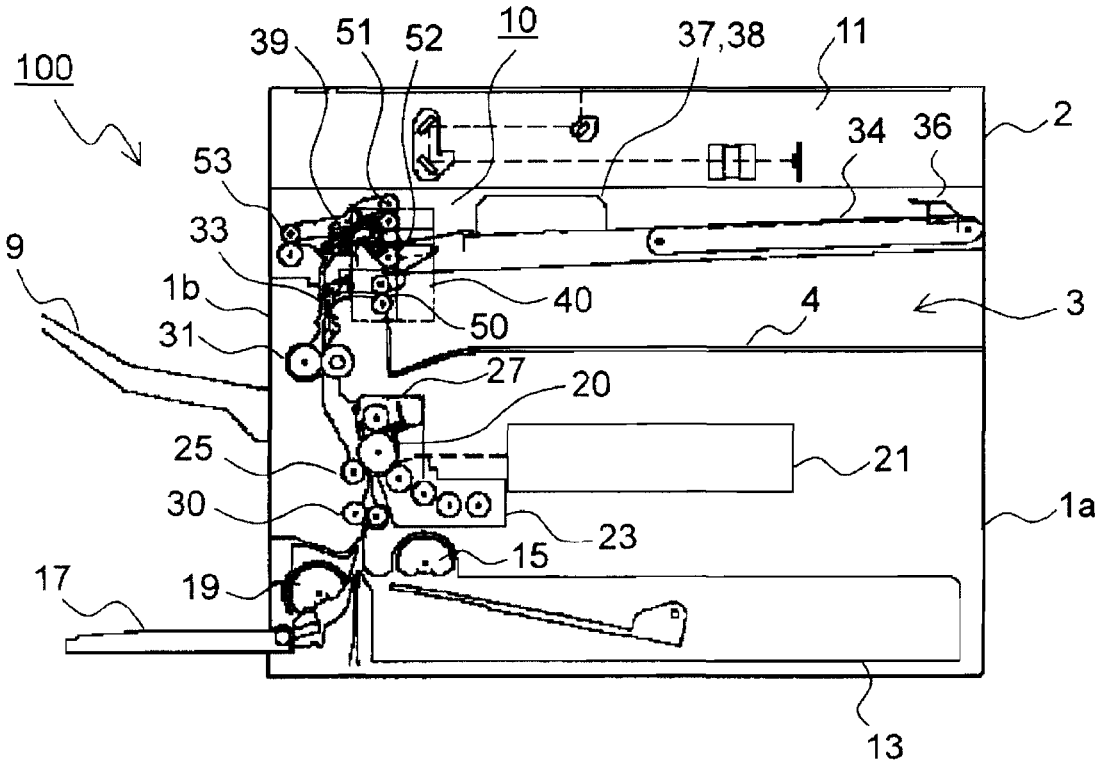
FIG. 2 is a cross sectional view showing an internal architecture of the image forming apparatus according to the embodiment of the present invention.

FIG. 2 is a cross sectional view showing an internal architecture of the image forming apparatus 100 according to an embodiment of the present invention. It should be noted that the document conveying unit 7 and the document holding member 8 are omitted in FIG. 2. A document reader 11 is provided at the uppermost portion of the upper housing 2 of the image forming apparatus 100. In addition, a paper cassette 13 is provided at a lower portion of the lower housing 1*a*. Sheets of paper accommodated in the paper cassette 13 are fed out one at a time by a paper feed roller 15. A manual feed tray 17 for manually feeding paper that can be opened and closed is provided at a lower portion of the left side of the lower housing 1*a*. Sheets of paper set in the manual feed tray 17 are also fed out one at a time by a paper feed roller 19.

Inside the main housing 1 a photosensitive drum 20 for forming an electrostatic latent image is installed. Around the photosensitive drum 20, a charging unit (not shown) for charging a surface of the photosensitive drum 20, exposure unit 21, developing unit 23, transfer roller 25 and cleaning unit 27 are disposed in a direction of the rotation of the photosensitive drum 20 (a clockwise direction in FIG. 2). The surface of the photosensitive drum 20 evenly charged by the charging unit is exposed by the light from the exposure unit 21 in response to electric signals related to an image of an original document so as to produce an electrostatic latent image, which is developed into a toner image by using toner supplied by the developing unit 23.

A timing of the sheets of paper feeding out one at a time from the paper cassette 13 or the manual feed tray 17 is adjusted by a pair of resist rollers 30. The sheet of paper is conveyed to a nip portion between the photosensitive drum 20 and the transfer roller 25. In this manner, the toner image on the photosensitive drum 20 is transferred to a sheet of paper, which is to be conveyed to a fixing unit 31. The fixing unit 31 causes a heating roller and a pressing roller to apply heat and pressure to the sheet of paper such that the image of toner is fixed on the sheet of paper. After the toner image is transferred to the sheet of paper, the cleaning unit 27 removes the residual toner on the surface of the photosensitive drum 20 so as to prepare for the consequent forming of a toner image.

In the downstream of the fixing unit 31 (downstream in a direction of conveying sheets of paper and upward in FIG. 2) a switching claw 33 is provided. The switching claw 33 selectably guides the sheets of paper conveyed from the fixing unit 31 into one of the internal paper discharging space 3 of the main housing 1 and the post-processing unit 10. The post-processing unit 10 is provided with a processing tray 34, stopper 35 (see FIG. 6) aligning the ends of the sheets of paper, sliding-forward member 36 for aligning the sheets of paper at the stopper 35, a pair of width aligning members 37 and 38 for aligning the width of the sheets of paper, branching lever 39, and stapler 40 (a main unit).

Figure 3:
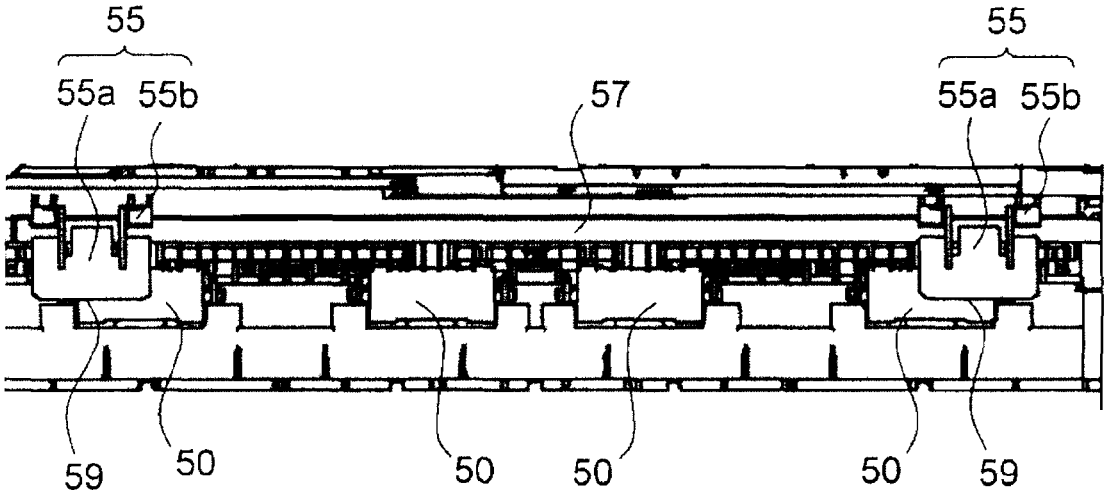
FIG. 3 is a front view showing a paper discharging outlet as seen in a discharging direction of paper.

If stapling is not conducted by the post processing unit 10, the switching claw 33 guides the sheets of paper on which images are formed into the internal paper discharging space 3 via a first pair of discharging rollers 50 and paper discharging outlet 57 (see FIG. 3, a recording medium discharging outlet). If stapling is required through the operation panel 5 (see FIG. 1), the branching lever 39 is rotated so as to switch to a waiting condition where the sheets of paper with images formed are ready to be discharged onto the processing tray 34. In this connection, on switching the branching lever 39, the switching claw 33 is switched so as to guide the sheets of paper into the post-processing unit 10. In the downstream of the first pair of discharging rollers 50 paper depressing members 55 (recording medium depressing members, see FIG. 3) are provided, which restrict curling of the sheets of paper discharged onto the paper discharging tray 4.

FIG. 3 is a front view showing the paper discharging outlet 57 as seen in a direction of discharging paper. The paper depressing members 55, which are disposed at left and right ends of the paper discharging outlet 57, respectively, include paper depressing plates 55*a* and supports 55*b* that pivotably support the paper depressing plates 55*a*. Lower ends 59 of the paper depressing plates 55*a* are adapted such that the lower ends 59 lie below the paper discharging outlet 57 when the paper depressing plates 55*a* are in a vertical position.

Since the sheets of paper having passed through the paper discharging outlet 57 are discharged onto the paper discharging tray 4 while the left and right ends of the sheets of paper at which remarkable curling occurs are in contact with the lower ends 59 of the paper depressing plates 55*a*, it is possible to efficiently restrict curling of the sheets of paper. In addition, since the paper depressing plates 55*a* are gravitationally restored to a vertical position after the end of a sheet of paper has passed, the lower ends 59 of the paper depressing plates 55*a* depress an upper surface of the sheet of paper so as to prevent the sheet of paper from lifting. Accordingly, even if a large number of sheets of paper are discharged onto the paper discharging tray 4, it is unlikely that the curled sheets of paper block the paper discharging outlet 57. As a result, it is possible to efficiently prevent not only a deterioration associated with arrangement and stacking of paper discharged onto the paper discharging tray 4, but also an anomaly such as pushing out the sheets of paper previously stacked off the paper discharging tray 4.

Figure 4:
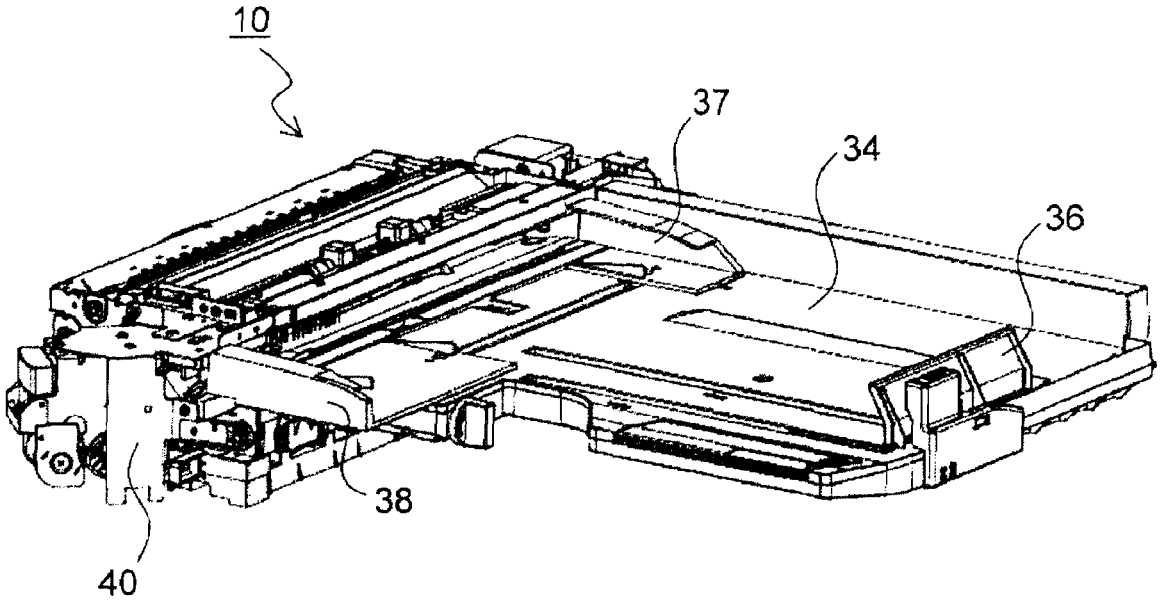
FIG. 4 is a perspective view showing a post-processing unit.
Figure 5:
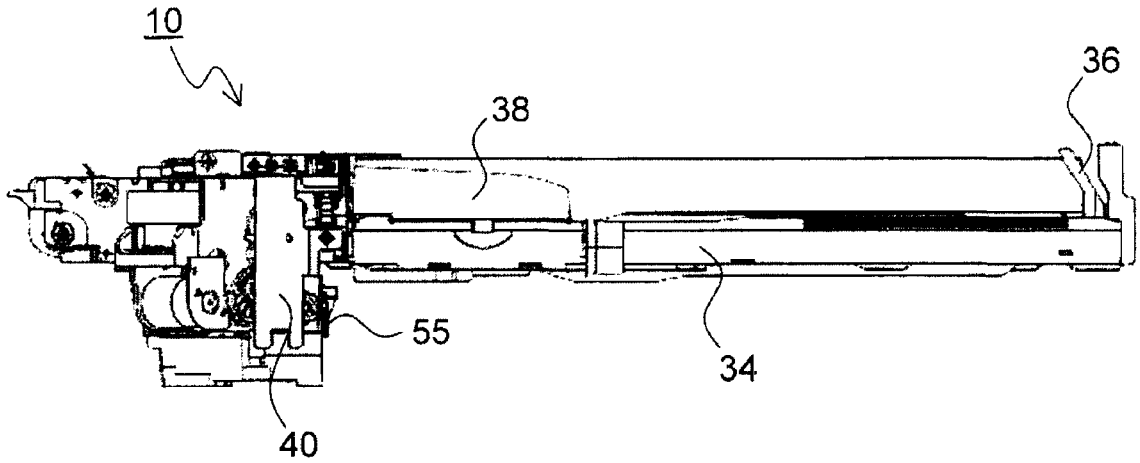
FIG. 5 is a front view showing the post-processing unit.
Figure 6:
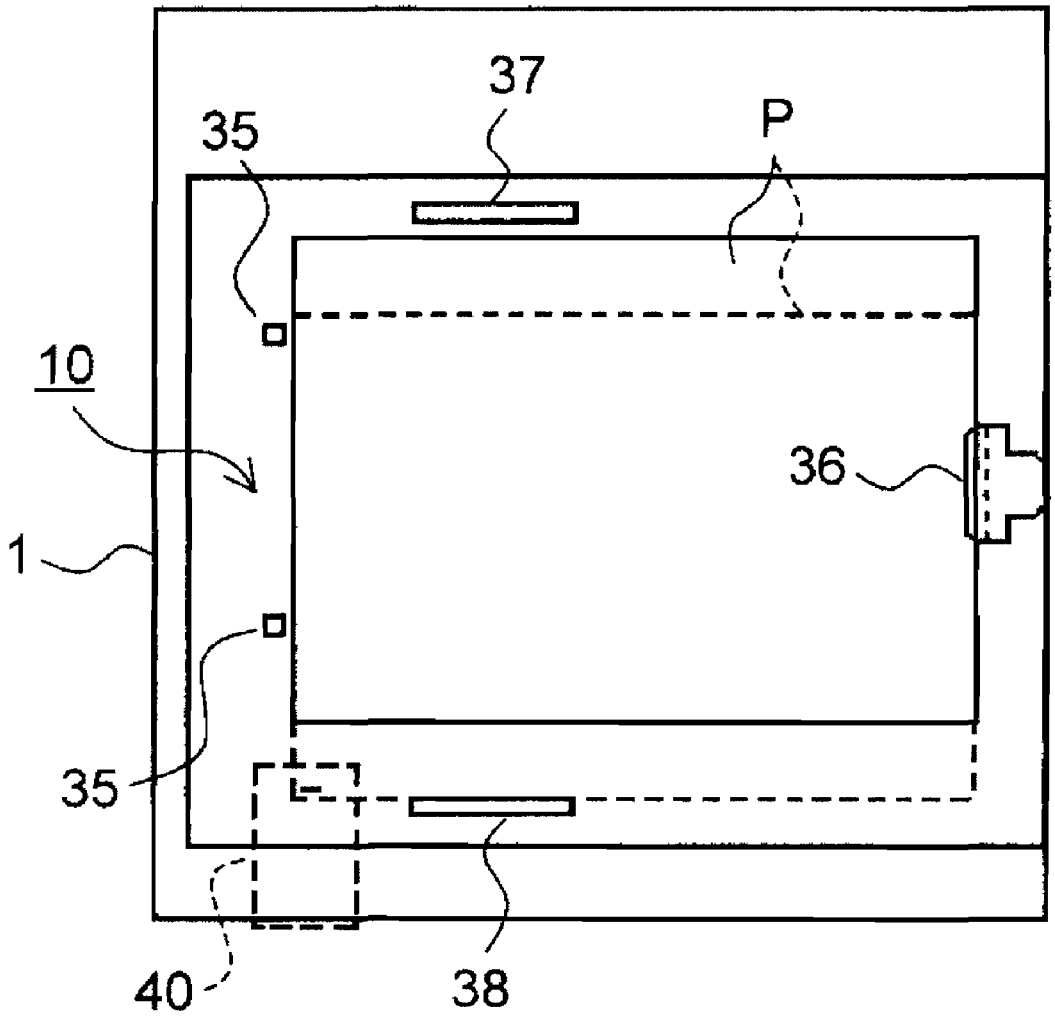
FIG. 6 is a plan view showing the post-processing unit as seen from an upward direction.

FIGS. 4 and 5 are perspective and front views each showing the post-processing unit 10. FIG. 6 is a plan view showing the post-processing unit 10 as seen from an upward direction. A description is given of the operation of the post-processing unit 10 with reference to FIGS. 2 and 4-6. A sheet of paper P discharged from the fixing unit 31 is discharged onto the processing tray 34 by a second pair of discharging rollers 51. When the sheet of paper P is discharged onto the processing tray 34, the shifting-forward member 36 travels in a left direction as shown in FIG. 6 to press the forward end of the sheet of paper P so as to push the backward end thereof against the stopper 35 to be aligned.

The width aligning member 37 disposed at the back of the processing tray 34 moves downward as shown in FIG. 6 so as to slide the sheet of paper P to the forward side of the main housing 1. Accordingly, the side end of the sheet of paper P abuts the width aligning member 38 that is disposed at the forward side of the main housing 1, so that the sheet of paper P is placed at a stapling position (as shown with a broken line in FIG. 6). Each time a sheet of paper P undergone image forming process is discharged, the process described above is repeated, whereby a stack of paper P on the processing tray 34 is placed at the stapling position. The description has been provided for an exemplary embodiment where the width aligning member 37 is moved so as to place the sheet of paper P at the stapling position. Alternatively, it may be possible to move the width aligning member 38, or both width aligning members 37 and 38 so as to place the sheet of paper P at the stapling position.

The stack of paper P is stapled by the stapler 40 with a predetermined number of sheets. Consequently, the stopper 35 is released and the branching lever 39 is rotated so as to discharge the stapled stack of paper P. A depressing roller 52 rises to work in collaboration with the second pair of discharging rollers 51 so that the stack of paper P is ready for being conveyed. The stack of paper P is conveyed in an opposite direction by the second pair of discharging rollers 51 reversely rotated and discharged onto the tray 9 for receiving a discharged stack of sheets of paper via a third pair of discharging rollers 53.

Figure 7:
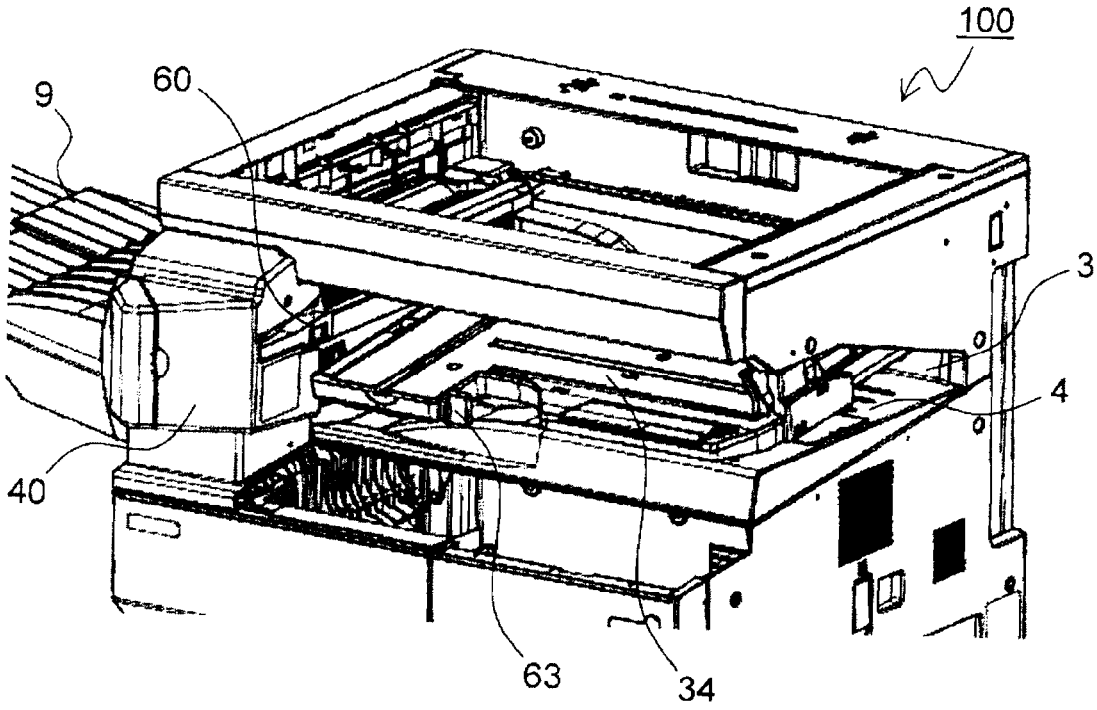
FIG. 7 is a perspective view showing an internal paper discharging space and the vicinity of the post-processing unit for a case where the processing tray is pivoted downward.
Figure 8:
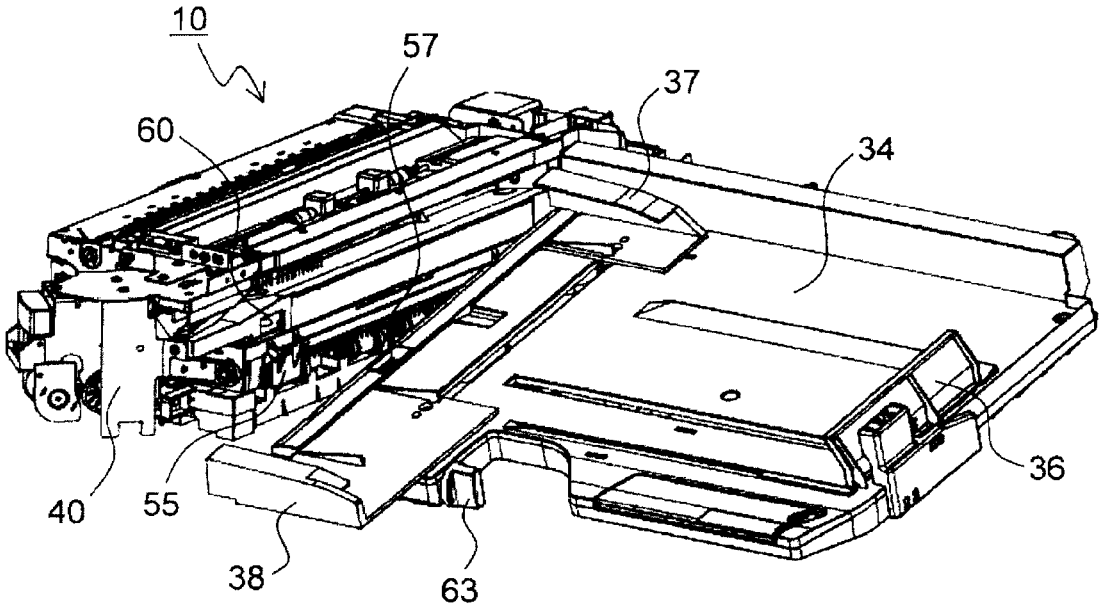
FIG. 8 is a perspective view showing the post-processing unit shown in FIG. 7.
Figure 9:
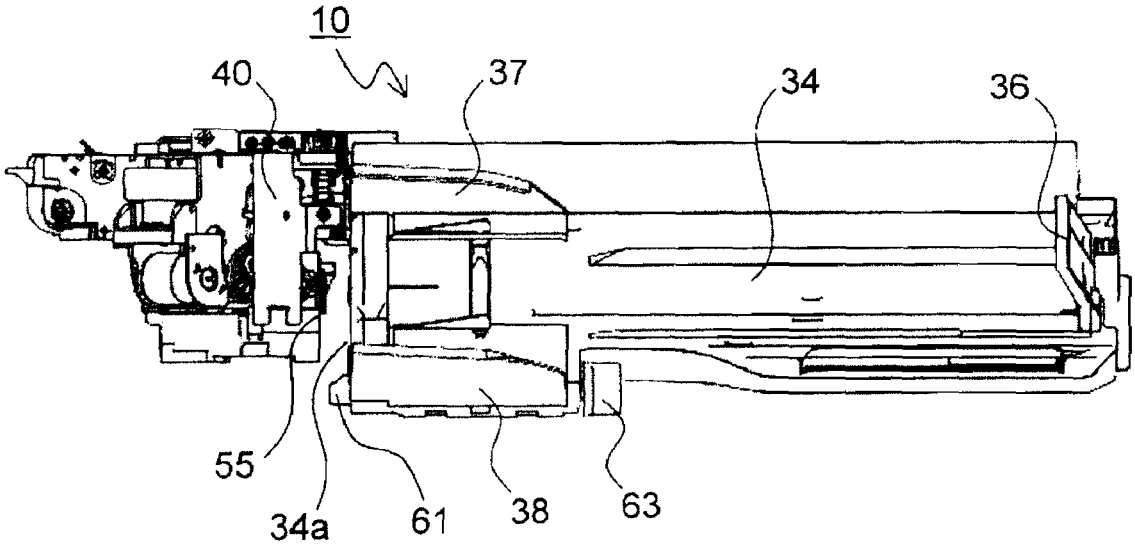
FIG. 9 is a front view showing the post-processing unit shown in FIG. 7.
Figure 10:
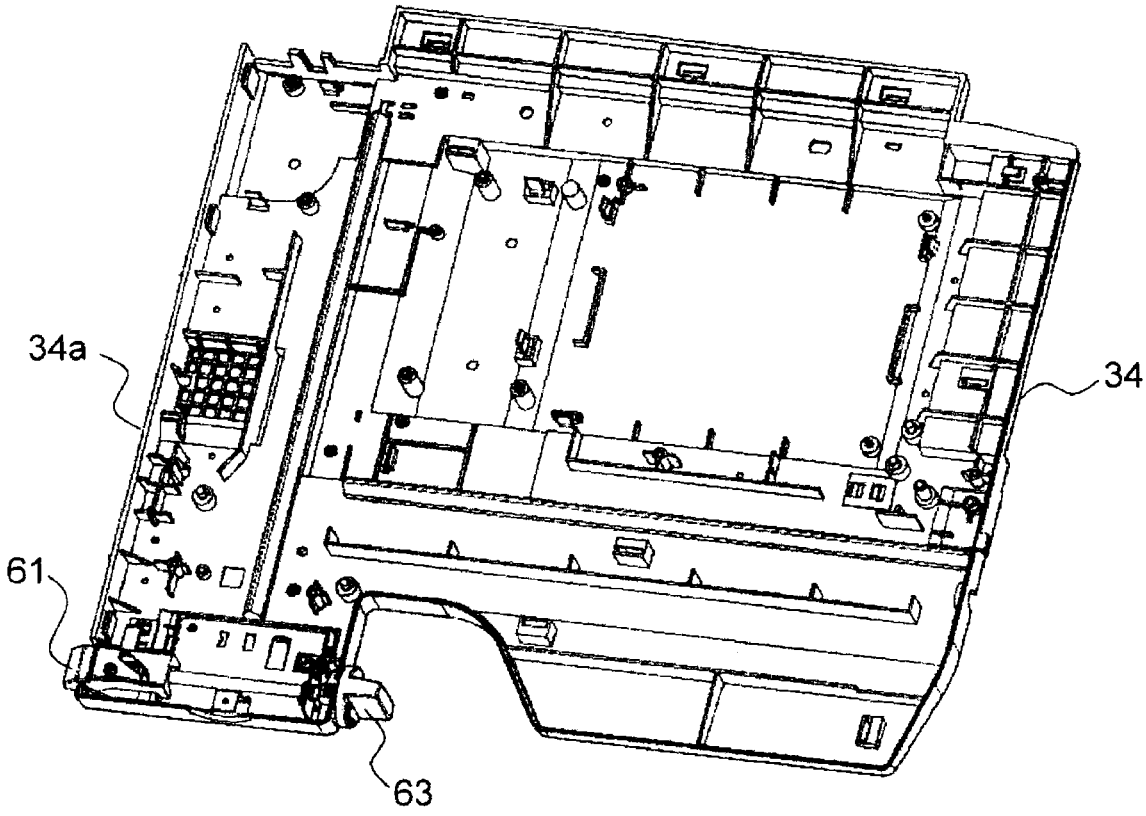
FIG. 10 is a perspective view showing the processing tray as seen from the back side.

FIG. 7 is a perspective view showing the internal paper discharging space 3 and the vicinity of the post-processing unit 10 for a case where the processing tray 34 is pivoted downward. FIGS. 8 and 9 are perspective and front views each showing the post-processing unit 10 shown in FIG. 7. FIG. 10 is a perspective view showing the processing tray 34 as seen from the back side thereof. It should be noted that the document reader 11 is omitted in FIG. 7 for convenience sake of description. The processing tray 34 is supported pivotably in a vertical direction about an axis defined by a side of the processing tray 34, the side lying deep in the image forming apparatus 100. At an end surface 34*a* facing the paper discharging outlet of the post-processing unit 10 (left side) a lock member 61 is provided, which holds the processing tray 34 horizontally while engaging with an engaging hole 60 formed in the stapler 40 (a main unit). At a forward end portion of the processing tray 34 a lock releasing lever 63 (a lock releasing member) is provided. A manipulation of the lock releasing lever 63 allows the lock member 61 to resist the urging force applied by a compression coil spring 69 (an urging member, see FIG. 11) and to be stored inside the processing tray 34.

Figure 11A:
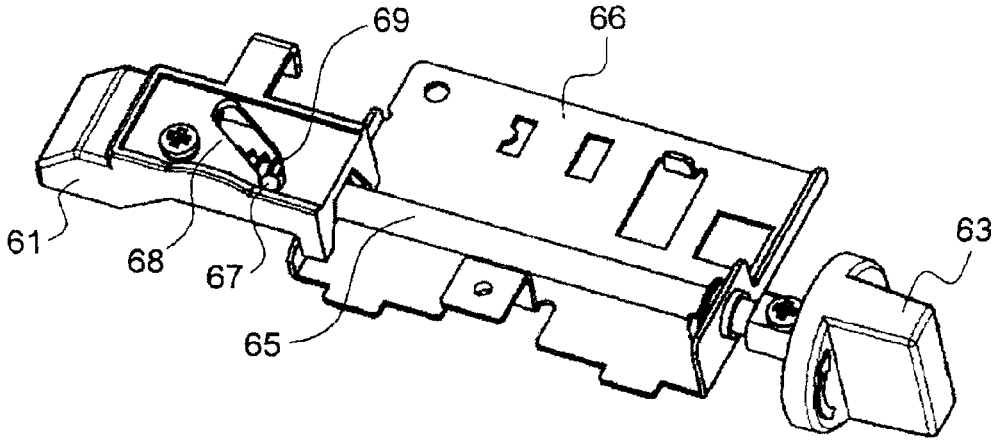
FIGS. 11(*a*)-11(*c*) are a perspective view, plan view and cross sectional view, each showing a lock member and a lock releasing lever.
Figure 11B:
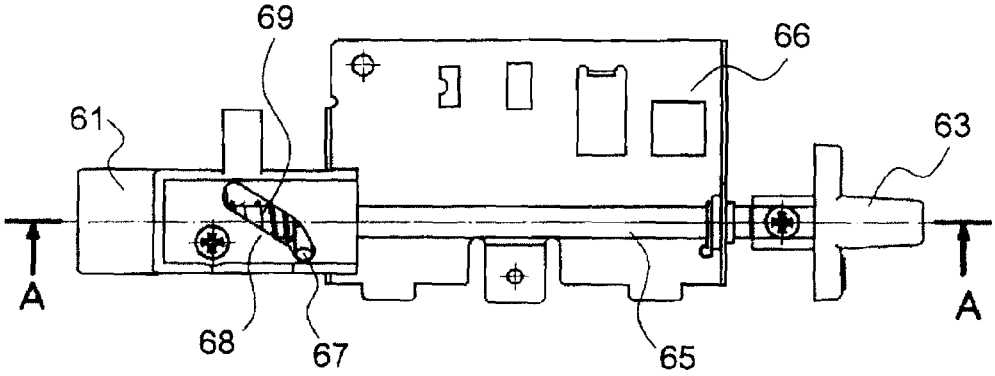
Figure 11C:
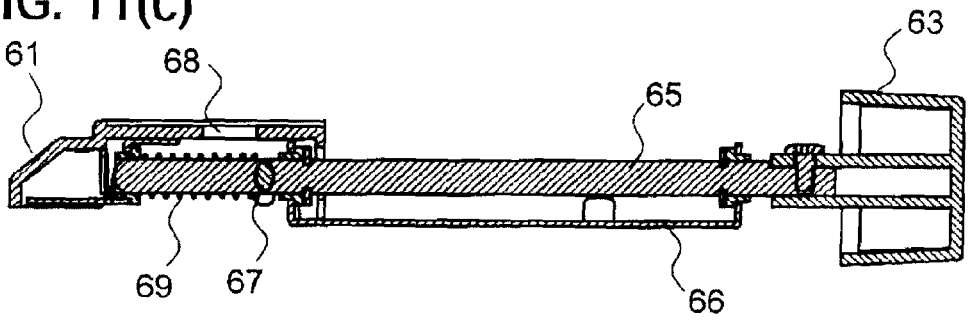
Figure 12A:
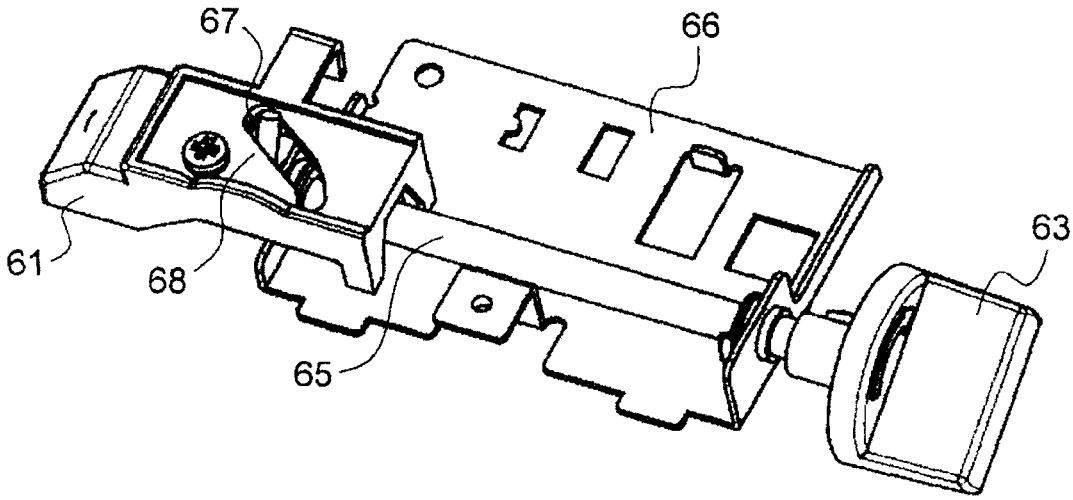
FIGS. 12(*a*)-12(*c*) are a perspective view, plan view and cross sectional view, each showing the lock member in a disengaged state.
Figure 12B:
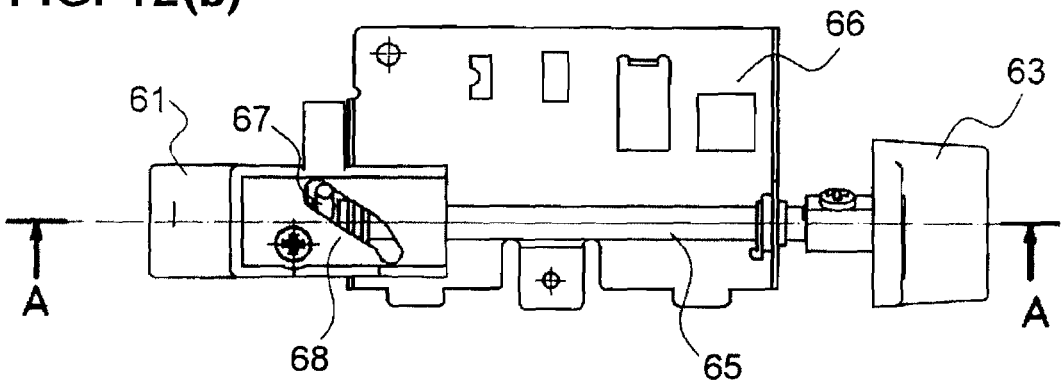
Figure 12C:
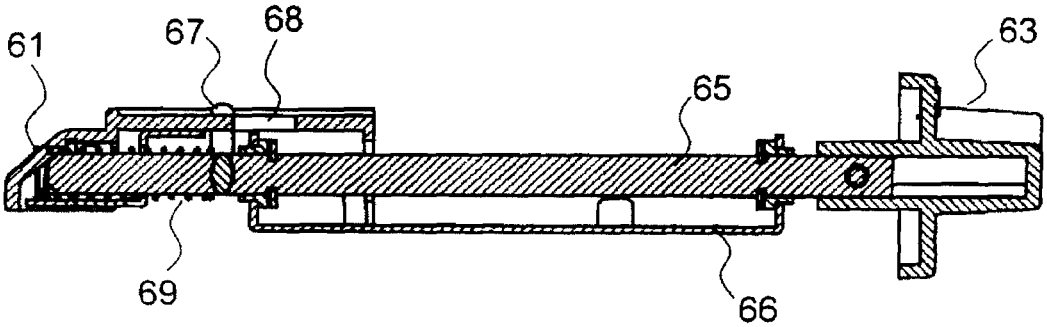

FIGS. 11(*a*)-11(*c*) and FIGS. 12(*a*)-12(*c*) are a perspective view, plan view and cross sectional view (taken along line A-A in FIGS. 11(*b*) and 12(*b*)), each showing the lock member 61 and the lock releasing lever 63. A description in detail is provided for the operation of the lock releasing lever 63 and lock member 61 with reference to FIGS. 11 (*a*) to 11 (*c*) and FIGS. 12 (*a*) to 12 (*c*). The lock releasing lever 63 (lock releasing member) is fixed at one end of a shaft 65 that is rotatably supported on a backside of the processing tray 34 via a bearing 66. The other end of the shaft 65 is inserted into the lock member 61. A parallel pin 67 projecting from the circumferential surface of the shaft 65 engages with an oblong hole 68 formed in an upper surface of the lock member 61. The compression coil spring 69 is installed around the shaft 65 between the other end of the shaft 65 and the parallel pin 67.

Figure 13A:
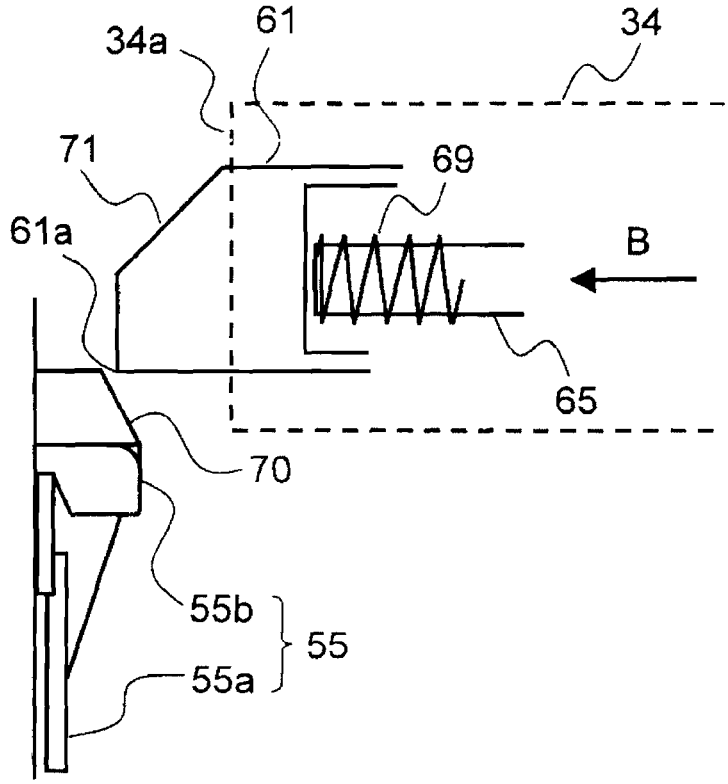
FIGS. 13(*a*) and 13(*b*) are side views, each illustrating the lock member traveling downward in front of a paper depressing member.
Figure 13B:
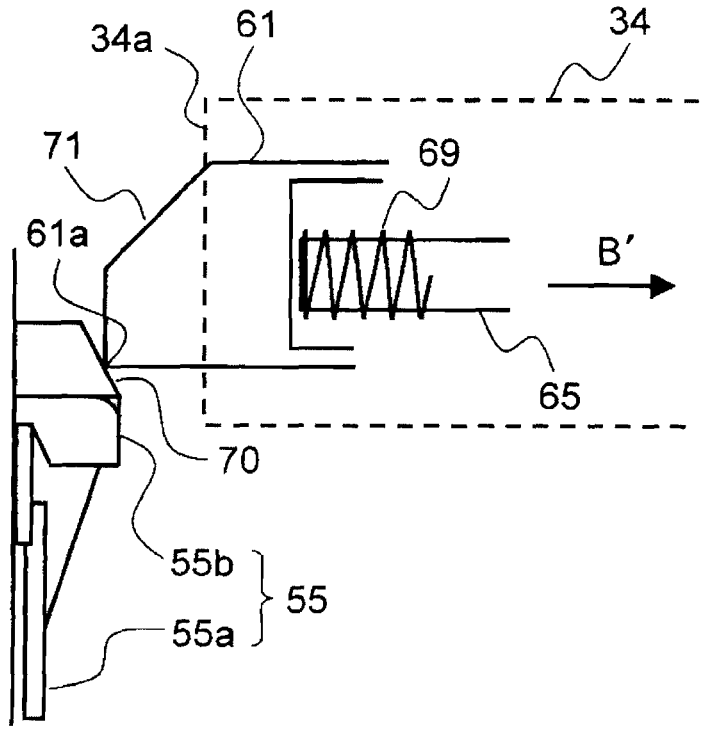

As shown in FIGS. 11(*a*)-(*c*), while the lock member 61 is engaging with the engaging hole 60 provided in the stapler 40, the lock member 61 is urged by the compression coil spring 69 in a direction (in a direction of arrow B, see FIG. 13(*a*)) in which the lock member 61 projects from the end surface 34*a* (see FIG. 13). Simultaneously, the parallel pin 67 engages with the utmost deep portion of the oblong hole 68 (the right end portion as shown in FIGS. 11(*a*)-11(*c*)).

When the lock member 61 and the engaging hole 60 are required to disengage from each other, it is necessary to rotate the lock releasing lever 63 by 90 degrees with respect to the position as shown in FIGS. 11(*a*)-11(*c*). This causes the shaft 65 and the parallel pin 67 along with the lock release lever 63 to rotate 90 degrees, moving the parallel pin 67 to the utmost forward portion (the left end as shown in FIGS. 12(*a*)-12(*c*)) in the oblong hole 68 while compressing the compression coil spring 69. Accordingly, the lock member 61 moves while resisting the urging force applied by the compression coil spring 69 in a direction of an arrow B' (see FIG. 13(*b*)), and so the lock member 61 is stored in the processing tray 34.

The lock member 61 is movable, by the lock releasing lever 63 and the compression coil spring 69, between one position (hereinafter referred to as "first position") in which the lock member 61 can project from the end surface 34*a* to engage with the engaging hole 60 and the other position (hereinafter referred to as "second position") in which the lock member 61 can be disengaged from the engaging hole 60 to be stored in the processing tray 34.

In case a paper jam occurs on the processing tray 34, a user manipulates the lock releasing lever 63 so as to disengage the lock member 61 from the engaging hole 60. This causes the processing tray 34 to rotate downward from the original position as shown in FIG. 4 so as to occupy another position as shown in FIGS. 7 and 8. Under this rotated position, the user removes the sheets of paper on the processing tray 34 to implement recovery from the jam. After the completion of recovery, the user rotates the processing tray 34 upward so as to engage the lock member 61 with the engaging hole 60 such that the lock member 61 is restored to the original position as shown in FIG. 4.

It is preferable that the processing tray 34 is rotated while being separated from the stapler 40 (main unit) as close as possible with respect to the second pair of rollers 51 such that the sheets of paper jammed on the way from the second pair of rollers 51 to the processing tray 34 can be smoothly removed. On the other hand, it is preferable that the paper depressing members 55 are disposed to project into the internal paper discharging space 3 such that the paper depressing members 55 not only prevent efficiently a sheet of paper discharged onto the paper discharging tray 4 from curling, but also depress the curls of the sheets of paper previously discharged onto the paper discharging tray 4 so as to maintain the arrangement and stacking of paper. This requires that the paper depressing members 55 are placed close to the pivotal range of the end surface 34*a* as long as the end surface 34*a* of the processing tray 34 and the paper depressing members 55 do not interfere with each other.

However, when the user manipulates the lock releasing lever 63 to disengage the lock member 61 from the engaging hole 60 during the recovery from the jam and withdraws his/her hand from the lock releasing lever 63, the lock member 61 moves to the first position due to the urging force applied by the compression coil spring 69. The lock member 61, which is required to securely support the processing tray 34, is placed at a forward portion of the end surface 34*a* that lies away from the pivotal axis of the processing tray 34 located deep in the main housing 1. Accordingly, if the processing tray 34 is rotated downward while the lock member 61 is in the first position, a paper depressing member 55 placed on the left side (corresponding to the forward with respect to the image forming apparatus 100) of the paper discharging outlet 57 (see FIG. 3) collides with the lock member 61.

As shown in FIGS. 13(*a*) and 13(*b*), a first slope 70 is provided on an upper surface (contact portion), with which the lock member 61 comes into contact, of a support 55*b* of the paper depressing member 55. When the user withdraws his/her hand from the lock releasing lever 63, the lock member 61 that is urged in the direction of the arrow B by the compression coil spring 69 lies in the first position projecting from the end surface 34*a* as shown in FIG. 13(*a*). If the processing tray 34 is rotated downward from this position, the lock member 61 approaches from upward to the paper depressing member 55, a lower end portion 61*a* (contact portion) of the lock member 61 coming into contact with the first slope 70.

Since the lock member 61 is applied the force in a direction of arrow B' as shown in FIG. 13(*b*) as a result of the lower end portion 61*a* abutting the first slope 70, the lock member 61 moves in the direction of arrow B' resisting the urging force exerted by the compression coil spring 69. Consequently, the lock member 61 having moved to the lower end of the first slope 70 climbs over the support 55*b* and travels downward in front of the paper depressing member 55 while pressing a paper depressing plate 55*a* in a left direction.

Figure 14A:
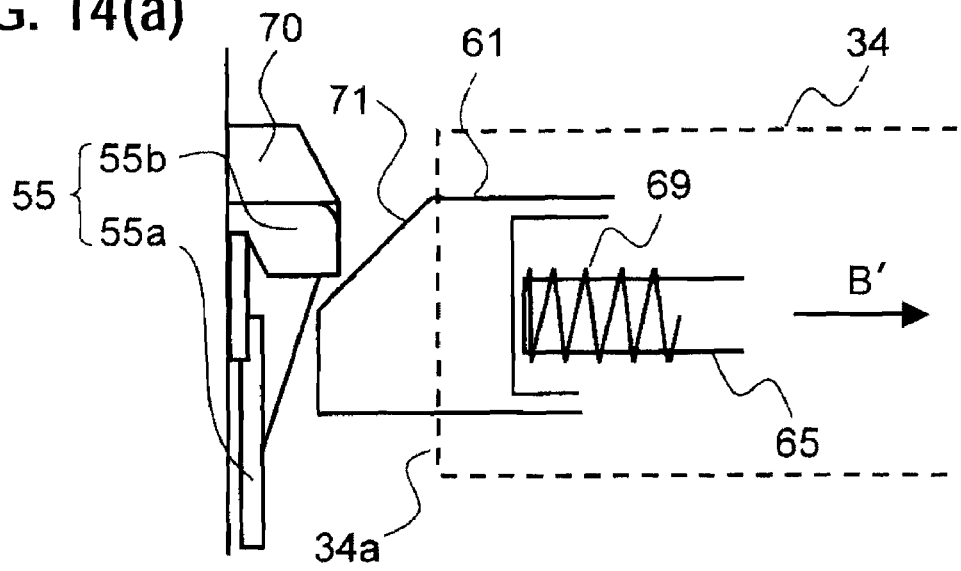
FIGS. 14(*a*) and 14(*b*) are side views, each illustrating the lock member traveling upward in front of the paper depressing member.
Figure 14B:
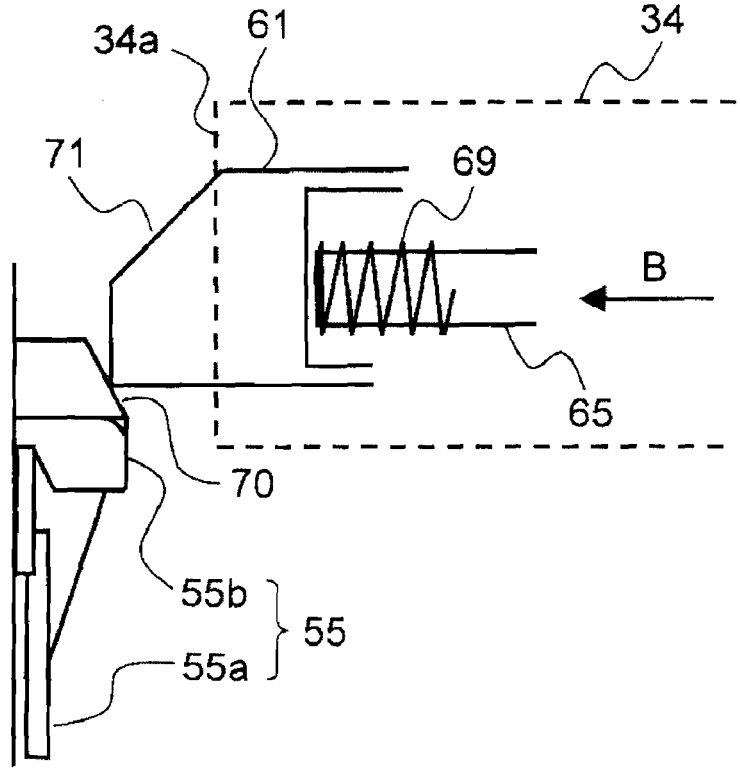

On the other hand, when the processing tray 34 is rotated upward, a second slop 71 provided on an upper corner of the lock member 61 comes into contact with the lower end of the support 55*b* while pressing the paper depressing plate 55*a* in left directions as shown in FIG. 14(*a*), whereby the lock member 61 moves in the direction of arrow B' resisting the urging force applied by the compression coil spring 69. Subsequently, as shown in FIG. 14 (*b*), the lock member 61 travels upward in front of the paper depressing member 55 while progressively moves along the first slope 70 in the direction of arrow B due to the urging force exerted by the compression coil spring 69.

Figure 15A:
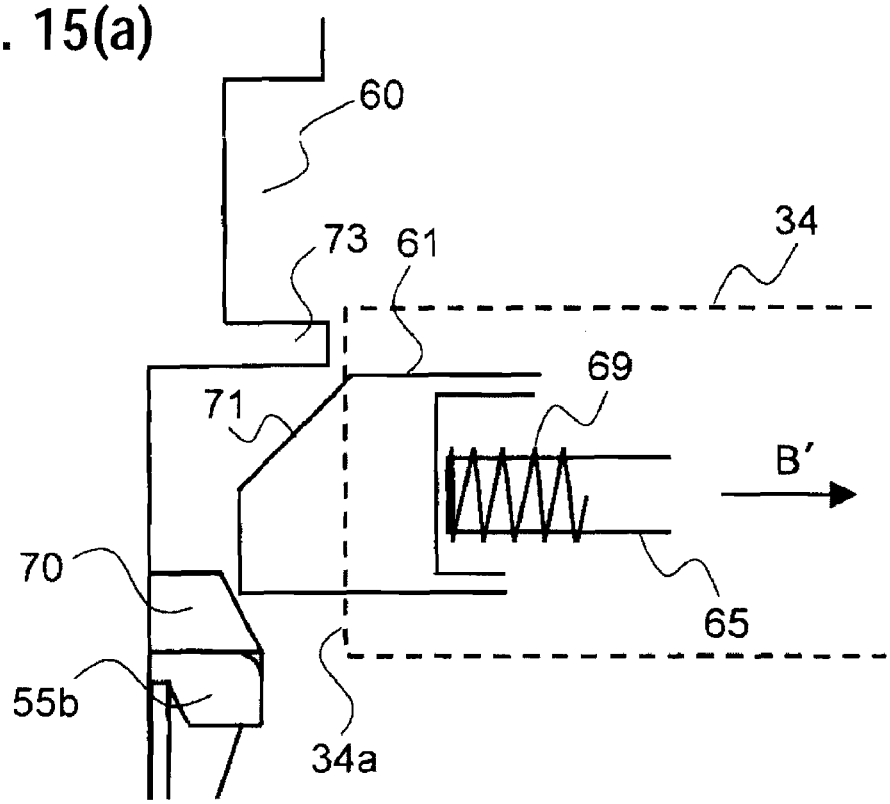
FIGS. 15(*a*) and 15(*b*) are side views, each illustrating the lock member engaging with an engaging hole.
Figure 15B:
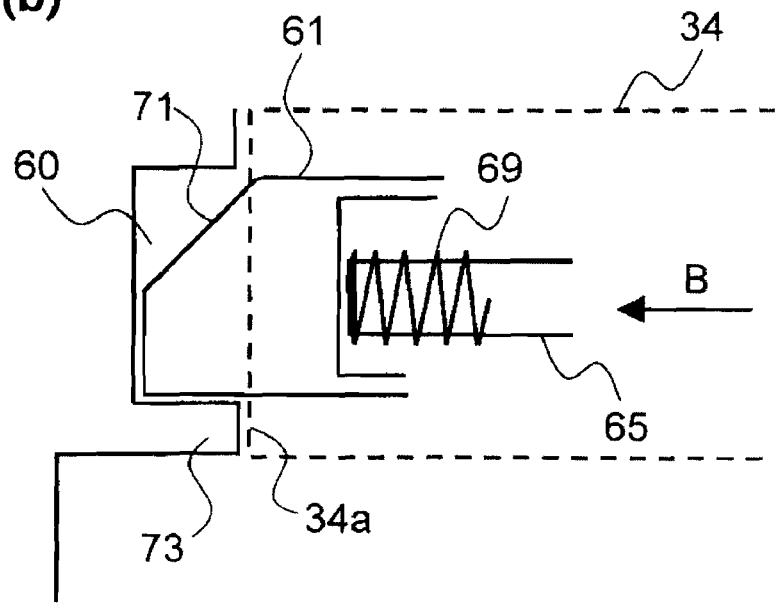

When the processing tray 34 is further rotated upward, the lock member 61 comes into contact with a lower end 73 of the stapler 40 (main unit) under the engaging hole 60, as shown in FIG. 15(*a*). The lock member 61 moves upward while the second slope 71 is in contact with the lower end 73, passing before the lower end 73 while moving in the direction of arrow B' against the urging force exerted by the compression coil spring 69. When the end surface 34*a* of the processing tray 34 subsequently rotates to reach the engaging hole 60 as shown in FIG. 15(*b*), the lock member 61 moves to the first position due to the urging force applied by the compression coil spring 69, thereby engaging with the engaging hole 60.

With the apparatus described above, it is possible to prevent the paper depressing member 55 and the lock member 61 from interfering with each other even if the user rotate the processing tray 34 while he/she withdraws his/her hand from the lock releasing lever 63. Accordingly, it is possible to securely prevent the paper depressing member 55 and the lock member 61 from suffering from damage. Since it is possible to place the paper depressing member 55 close to the pivotal range of the end surface 34*a*, it is possible to achieve the following advantages: The workability is increased for clearing away the sheets of paper that have been jammed on the way to the processing tray 34. It is possible to prevent the sheets of paper to be discharged onto the paper discharging tray 4 from curling. Furthermore, it is possible to maintain the performance associated with the arrangement and stacking of paper.

Figure 16:
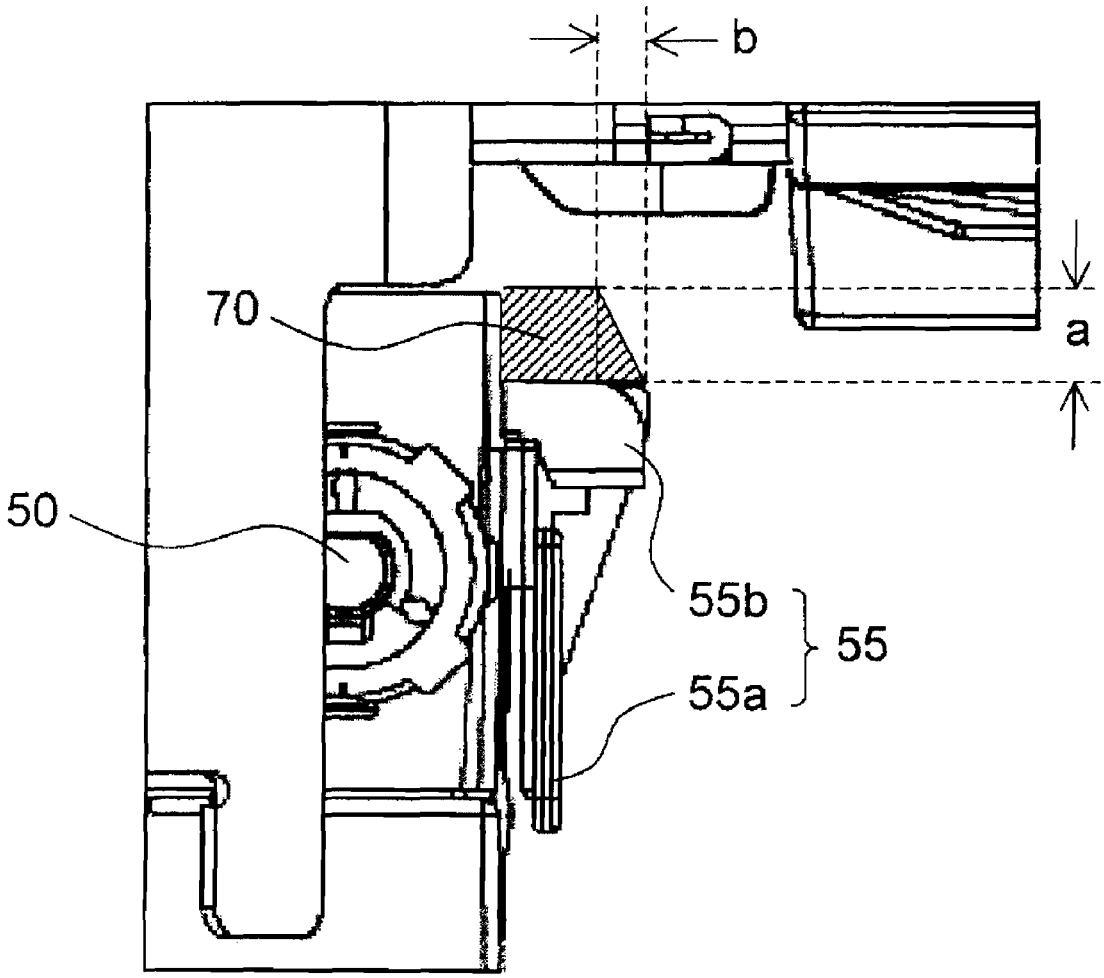
FIG. 16 is a side view showing the paper depressing member.
Figure 17A:
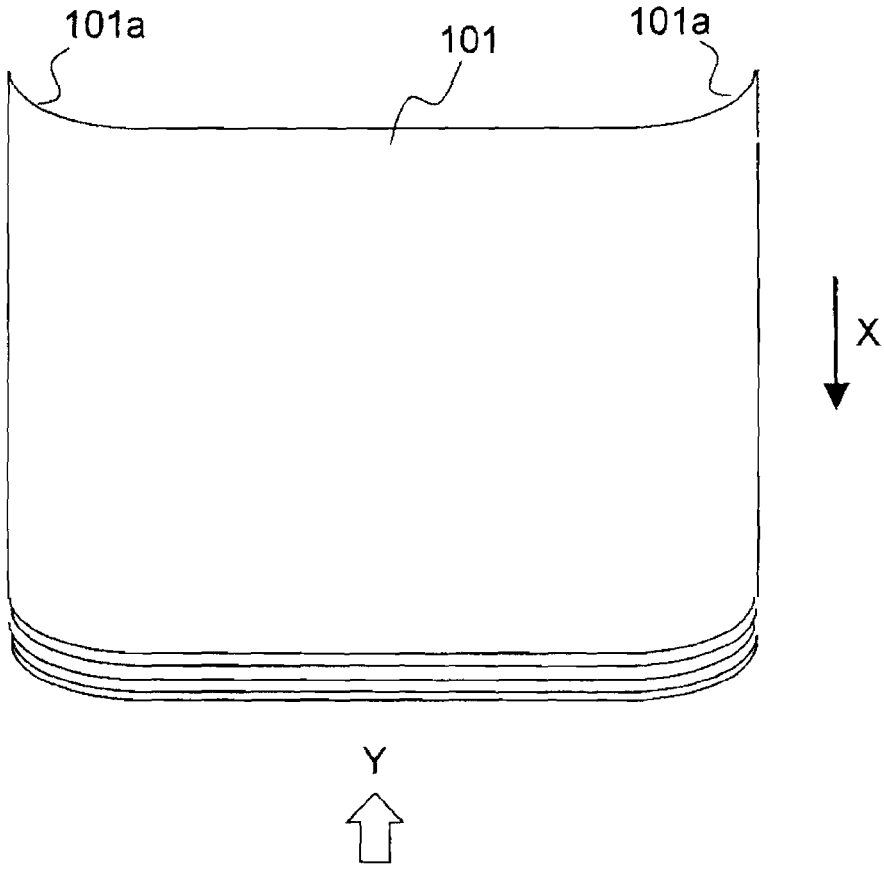
FIG. 17(*a*) is a perspective view illustrating sheets of paper having curls at left and right ends thereof, and FIG. 17 (*b*) is a side view illustrating one of the sheets of paper shown in FIG. 17 (*a*).
Figure 17B:
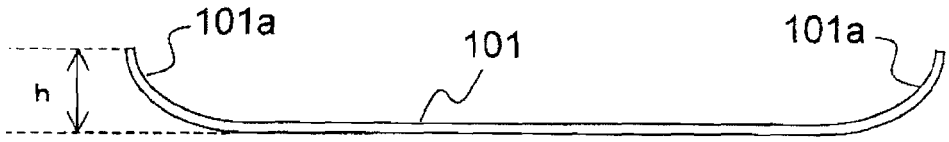

In this connection, it may be preferable that a dimension "a" is greater than a dimension "b" as viewed in a cross section of the first slope 70 and the gradient of the first slope is not less than 45 degrees, as shown in FIG. 16. This allows a force required for rotating the processing tray 34 downward to be decreased since the lower end 61*a* of the lock member 61 can smoothly travel along the surface of the first slope 70.

While the invention has been described in detail and with reference to specific embodiments thereof, it will be apparent to one skilled in the art that various changes and modifications can be made therein without departing from the spirit and scope thereof. In the embodiment described above, the first slope 70 is provided on the upper surface of the support 55*b* of the paper depressing member 55 on which the lock member 61 abuts while the processing tray pivots downwardly. Alternatively, it may be possible to dispose the first slope 70 on the lock member 61 or both the lock member 61 and the paper depressing member 55. Although the description has been provided for the embodiment in which the paper depressing member 55 includes the paper depressing plate 55*a* and the support 55*b*, it may be alternatively possible to adopt a flexible film in place of the paper depressing plate 55*a* that is adapted to swing. The present invention is not limited to a monochromatic copier as shown in FIG. 1, but applicable to various types of image forming apparatus such as a color copier with a post-processing unit, and facsimile machine, etc.

What is claimed is:

1. An image forming apparatus, comprising:

a main housing;

an upper housing;

a connecting housing to connect the main housing and the upper housing;

an inner paper discharging space provided between the upper housing and the main housing;

a post-processing unit that is provided at an upper portion of the inner paper discharging space;

a recording medium discharging outlet discharging recording media from the connecting housing, said recording medium discharging outlet positioned downward from the post-processing unit; and a recording medium discharging tray that is provided at a lower portion of the inner paper discharging space and to which recording medium having image thereon which is not undergone post-processing is discharged via the recording medium discharging outlet, wherein the post-processing unit comprises:

a main unit; and a processing tray that is supported pivotably in a vertical direction with respect to the main unit about an axis defined by a side of the processing tray, wherein the processing tray comprises:

a lock member that is supported movably between a first position and a second position, the lock member being engagable with an engaging hole provided in the main unit at the first position while projecting from an end surface of the processing tray and disengagable from the engaging hole at the second position while being accommodated in the processing tray;

an urging member urging the lock member towards the first position; and a lock releasing member resisting an urging force applied by the urging member so as to allow the lock member to travel to the second position, wherein a recording medium depressing member that depresses the recording medium having passed through the recording medium discharging outlet is disposed within a pivotal range of the lock member, and wherein a first slope is provided on at least one of a contact portion of the lock member and a contact portion of the recording medium depressing member, both of which contact each other when the processing tray pivots downward.

2. The image forming apparatus according to claim 1, wherein a vertical dimension is greater than a horizontal dimension with respect to a cross sectional view of the first slope.

3. The image forming apparatus according to claim 2, wherein a second slope is provided on a portion of the lock member on which the recording medium depressing member abuts when the processing tray pivots upward.

4. The image forming apparatus according to claim 1, wherein a second slope is provided on a portion of the lock member on which the recording medium depressing member abuts when the processing tray pivots upward.

5. A post-processing unit for an image forming apparatus, the image forming apparatus comprising:

a main housing;

an upper housing;

a connecting housing to connect the main housing and the upper housing; and an inner paper discharging space provided between the upper housing and the main housing;

a recording medium discharging outlet discharging recording media from the connecting housing, said recording medium discharging outlet positioned downward from the post-processing unit, and a recording medium discharging tray that is provided at a lower portion of the inner paper discharging space and to which recording medium having image thereon which is not undergone post-processing is discharged via the recording medium discharging outlet, wherein the post-processing unit is provided at an upper portion of the inner paper discharging space comprising:

a main unit; and a processing tray that is supported pivotably in a vertical direction with respect to the main unit about an axis defined by a side of the processing tray;

wherein the processing tray comprises:

a lock member that is supported movably between a first position and a second position, the lock member being engagable with an engaging hole provided in the main unit at the first position while projecting from an end surface of the processing tray and disengagable from the engaging hole at the second position while being accommodated in the processing tray;

an urging member urging the lock member towards the first position; and a lock releasing member resisting an urging force applied by the urging member so as to allow the lock member to travel to the second position, wherein a recording medium depressing member that depresses the recording medium having passed through the recording medium discharging outlet is disposed within a pivotal range of the lock member, and wherein a first slope is provided on at least one of a contact portion of the lock member and a contact portion of the recording medium depressing member, both of which contact each other when the processing tray pivots downward.

6. The post-processing unit for an image forming apparatus according to claim 5, wherein a vertical dimension is greater than a horizontal dimension with respect to a cross sectional view of the first slope.

7. The post-processing unit for an image forming apparatus according to claim 6, wherein a second slope is provided on a portion of the lock member on which the recording medium depressing member abuts when the processing tray pivots upward.

8. The post-processing unit for an image forming apparatus according to claim 5, wherein a second slope is provided on a portion of the lock member on which the recording medium depressing member abuts when the processing tray pivots upward.

* * * * *